United States Patent [19]

Babb

[11] 4,144,416

[45] Mar. 13, 1979

[54] UNITARY TUNED PORT AND LOUDSPEAKER FRAME

[75] Inventor: Burton A. Babb, Dallas, Tex.

[73] Assignee: Babbco, Ltd., Dallas, Tex.

[21] Appl. No.: 779,320

[22] Filed: Mar. 21, 1977

Related U.S. Application Data

[63] Continuation-in-part of Ser. No. 669,315, Mar. 22, 1976, which is a continuation-in-part of Ser. No. 372,074, Jun. 21, 1973, Pat. No. 3,983,337.

[51] Int. Cl.[2] ..... H04R 1/28; H04R 9/06

[52] U.S. Cl. ..... 179/115.5; 179/1 VE; 181/150; 181/156

[58] Field of Search ..... 179/1 VE, 1 E, 115.5 R, 179/179, 181 F; 181/148, 150, 153, 156, 199; 325/312

[56] References Cited

U.S. PATENT DOCUMENTS

| | | | |
|---|---|---|---|
| 1,741,274 | 12/1929 | Baumann | 181/156 |
| 1,869,178 | 7/1932 | Thuras | 179/115.5 R |
| 1,930,577 | 10/1933 | Atkinson | 181/148 |
| 2,900,040 | 8/1959 | Novak | 181/152 |
| 3,068,955 | 12/1962 | Van Hedel | 181/144 |
| 3,089,562 | 5/1963 | Morgillo | 181/156 |
| 3,135,348 | 6/1964 | Bill | 181/147 |
| 3,166,148 | 1/1965 | Tibbetts | 179/181 F |
| 3,240,289 | 3/1966 | Kishi | 181/199 |

FOREIGN PATENT DOCUMENTS

| | | | |
|---|---|---|---|
| 23345/35 | 8/1936 | Australia | 181/156 |
| 102684 | 12/1937 | Australia | 181/156 |
| 585748 | 10/1933 | Fed. Rep. of Germany | 179/146 R |
| 931897 | 3/1948 | France | 179/146 R |
| 528789 | 6/1955 | Italy | 181/156 |
| 628753 | 11/1961 | Italy | 181/156 |

OTHER PUBLICATIONS

*Radio Elektronik Schau,* vol. 52, No. 11, pp. 65–66, Nov. '76, "Loudspeaker-Boxes Perfection, made in U.S.A. Bose Presents Novel HiFi Boxes", F. Maderbacher.

*Primary Examiner*—George G. Stellar
*Attorney, Agent, or Firm*—Hubbard, Thurman, Turner, Tucker & Glaser

[57] ABSTRACT

A speaker assembly for mounting in an oval acoustic baffle opening such as the rear deck of an automobile comprises an oval unitary tuned port and frame for a moving voice coil loudspeaker.

6 Claims, 8 Drawing Figures

UNITARY TUNED PORT AND LOUDSPEAKER FRAME

CROSS REFERENCE TO RELATED APPLICATIONS

The present application is a continuation-in-part of application Ser. No. 669,315, entitled "Broad Band Dynamic Loudspeaker" filed Mar. 22, 1976, which is now U.S. Pat. No. 4,115,667, which in turn is a continuation-in-part of application Ser. No. 372,074 entitled "Broad Band Acoustic Speaker" filed June 21, 1973, which is now U.S. Pat. No. 3,983,337. The present application incorporates by reference all of the features described in the above recited applications, both of which were filed by Burton A. Babb and assigned to the same assignee of the present invention.

BACKGROUND OF THE INVENTION

1. Field of the Invention

The present invention relates generally to loudspeakers, and more particularly to bass reflex speaker systems.

2. Description of the Prior Art

Certain speaker applications in the prior art place constraints on size. In particular, the so-called "rear speaker" used in automobiles is mounted in the relatively narrow area between the car's rear seat and rear window. Such spatial constraints will not permit the use of conventional large diameter "woofer" speakers, which are typically used to produce the lower frequency audio sounds in prior art high fidelity equipment. In view of such relatively narrow spatial requirements, automobile rear speakers of the prior art have employed oval-shaped acoustic drivers to enhance the generation of low frequency audio energy in a relatively narrow spatial arrangement. Both 5" by 7" and 6" by 9" sizes of oval-shaped acoustic drivers have achieved wide acceptance and a substantial degree of standardization in the present day automotive rear speaker market.

The present invention provides a speaker system with improved sound reproduction which is compatible with prior art spatial constraints.

SUMMARY OF THE INVENTION

In accordance with the present invention, a speaker system having a broad-band frequency response with enhanced low frequency sound reproduction, is comprised of an acoustic driver and at least one tuned port disposed in a common basket. The basket is generally oval-shaped with a peripheral edge adapted to seal the basket in a similarly shaped opening in an enclosure.

In a first important embodiment of the invention, a circular acoustic driver is juxtaposed with a tuned port of circular cross section within an oval-shaped basket.

In a second important embodiment of the invention, a circular acoustic driver is juxtaposed between two tuned ports of generally crescent-shaped cross section within an oval-shaped basket.

It is anticipated that the speaker system of the present invention will be particularly useful in "rear speaker" automobile applications where spatial constraints restrict the width of the speaker. It is also anticipated, however, that the speaker system of the present invention will have advantageous application in other areas, such as televesion sets, where spatial considerations also restrict speaker size.

The novel features believed characteristic of the invention are set forth in the appended claims. The nature of the invention, however, as well as its essential features and advantages, may be understood more fully upon consideration of illustrative embodiments, when read in conjunction with the accompanying drawings, wherein:

DESCRIPTION OF THE PREFERRED EMBODIMENTS

Figure 1:
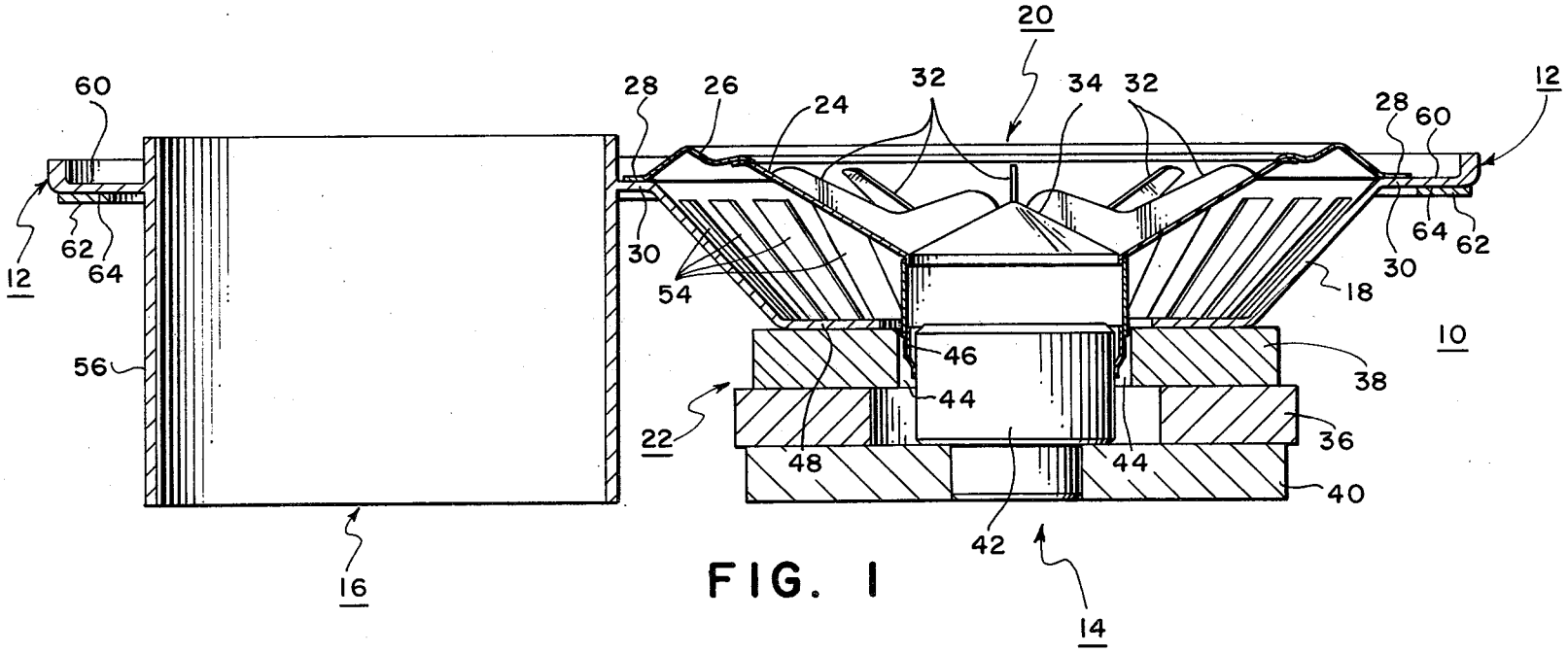
FIG. 1 is a cross section along a line of symmetry of a first embodiment of the invention.

Referring to FIG. 1, a braod-band loudspeaker of the present invention is indicated generally by the reference numeral 10. The loudspeaker 10 is comprised of a basket, an acoustic driver, and a tuned port member, indicated generally by the reference numerals 12, 14 and 16 respectively.

Figure 3:
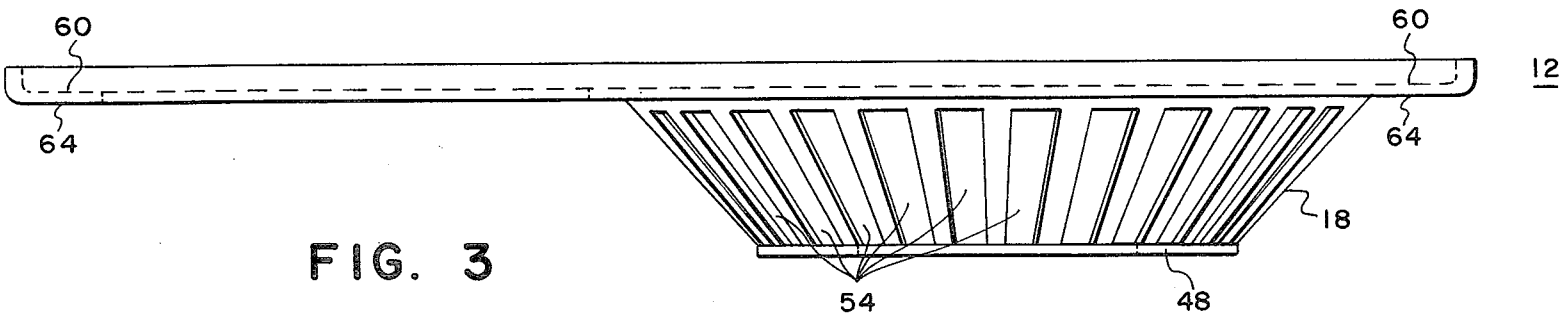
FIG. 3 is a side elevation of the basket of FIG. 2.
Figure 2:
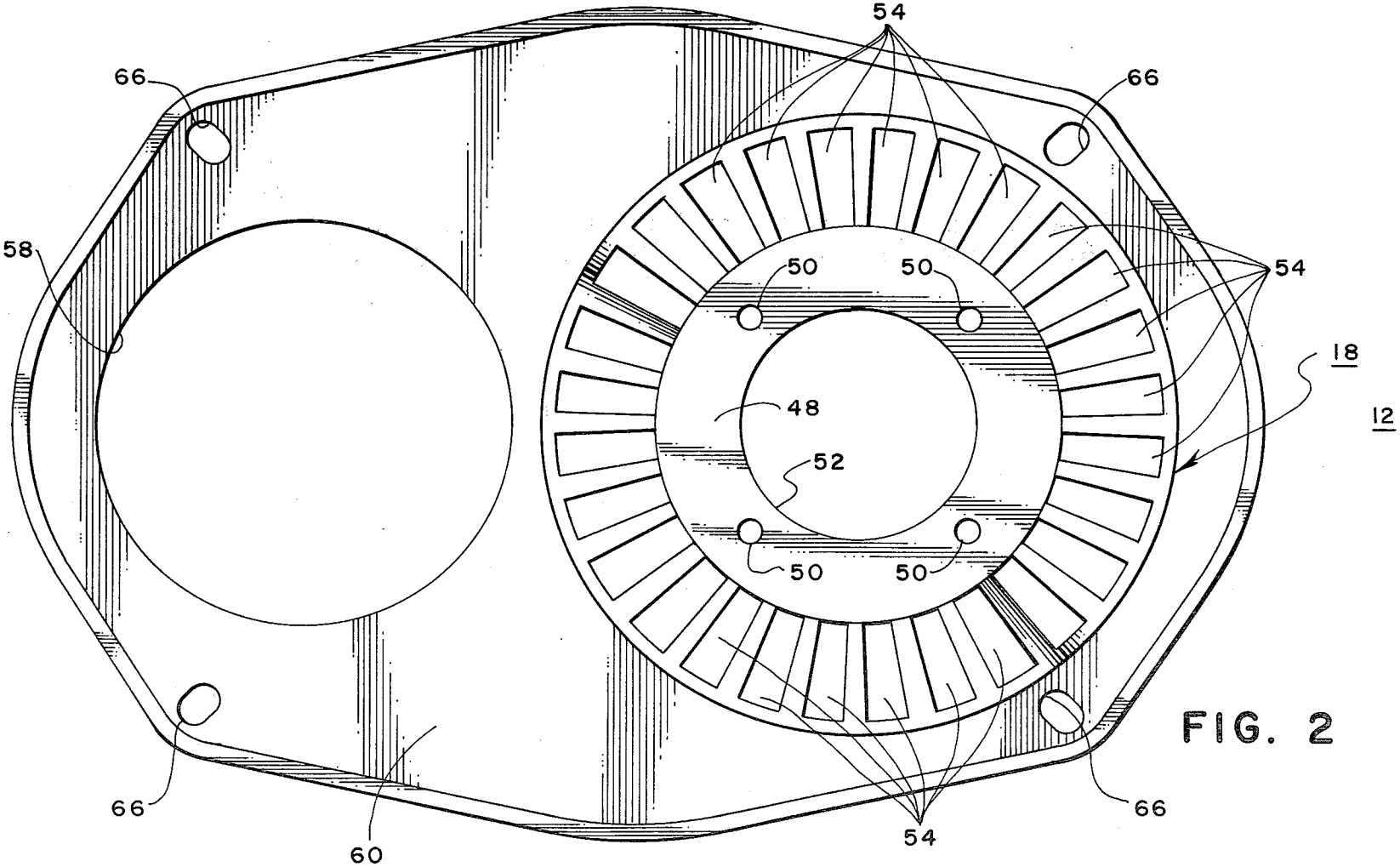
FIG. 2 is a plan view of a speaker basket of the first embodiment.

Referring briefly to FIGS. 2 and 3 wherein the details of the basket 12 are separately illustrated, it is seen that the basket 12 is generally oval in shape. The basket 12 is preferably a cast or stamped one-piece construction of steel or aluminum, but alternatively may be an injection molded plastic or other suitable material which provides a rigid unitary construction.

Referring again to FIG. 1, the acoustic driver 14 is mounted in a frustum-shaped portion 18 of the basket 12. The acoustic driver 14 is preferably the type having a reciprocating diaphragm and most preferably is of the type described in my co-pending application Ser. No. 669,315, referred to above. Briefly, the acoustic driver 14 is comprised of a reciprocating portion indicated generally by reference numeral 20, and a magnetic assembly indicated generally by reference numeral 22, complete details being described in application Ser. No. 669,315. Portion 20 of the acoustic driver 14 has a reciprocating diaphragm or speaker cone 24 of a paper-like construction known in the art. The cone 24 extends outward to a rolled edge portion 26 which terminates in an annular flange 28. The flange 28 is sealed to the basket 12 at the outer periphery 30 of the frustum 18. Most preferably, the reciprocating portion 20 comprises rib members 32, which are attached to the cone 24 and a dust cap 34 in the manner described in application Ser. No. 669,315.

The magnetic assembly 22 is comprised of a permanent magnet 36 and pole pieces 38 and 40, which are arranged with a cylindrical member 42 to provide an annular flux gap 44 through which a voice coil 46 is reciprocated in the manner described in application Ser. No. 669,315. The magnetic assembly 22 is affixed to the basket 12 at a lower annular portion 48 of frustum 18. Means for fastening the magnetic assembly 22 to the basket 12 is provided by mounting holes 50 in portion 48, which are explicitly illustrated in FIG. 2. The reciprocating portion 20 cooperates with the magnetic assembly 22 by extending through an aperture 52 in portion 48 of the basket 12. Disposed in the frustum 18 of the basket 12 are numerous slots 54 (only some of which are numbered for the sake of clarity) which permit the free passage of air in and out of the cavity generally defined by the speaker cone 24 and the frustum 18.

The tuned port member 16 of the loudspeaker 10 is comprised of a tubular duct 56, which may be an integral part of a basket as depicted in FIG. 1, or may be a discrete member attached to a basket (such as the basket 12 of FIG. 2) by an adhesive or other suitable means. If a duct and basket are cast or molded as a unitary structure, it may be necessary to provide a tapered duct to facilitate release from a mold, in a manner familiar to those skilled therewith. In the case of separately assembled duct and basket members, the duct may comprise any relatively rigid material, which may be fixed in place in an aperture 58 through generally flat top surface 60 of the basket 12. Preferred methods of assembling separate duct and basket members are discussed below in conjunction with FIGS. 6, 6A and 7. The effect of the tuned port 16 is to enhance the bass frequency efficiency and to increase the lower frequency response of the driver 14 by about 5 dB.

The loudspeaker 10 is intended to be operated in conjunction with an enclosure or baffle (not shown). A cushion 62 or other suitable means is provided at the periphery of back surface 64 of the basket 12 to provide an airtight seal for mounting the basket 12 in an enclosure. Mounting is facilitated by means of holes 66, shown explicitly in FIG. 2.

There is a known relationship in the art of bass reflexing between the resonance of an acoustic driver, the size of a tuned port, and the size of the enclosure. Prior art bass reflex systems employed speaker enclosures of precise dimensions. Loudspeaker 10 of the present invention is primarily designed for installation in the area behind the rear seat of an automobile, in which case the trunk of the automobile becomes the enclosure. The loudspeaker 10 of the present invention has been found to provide good audio performance over a relatively wide range of enclosure volumes and shapes, which to a large extent eliminates the problem of irregular trunk dimensions in providing a bass reflex system in an automobile.

In order to more fully illustrate the invention, the following dimensional details of one specific embodiment thereof will now be given with reference to FIGS. 1 to 3. The basket 12 of a loudspeaker 10 has an overall length of approximately 9½-inches and a width of approximately 6-inches. The mounting holes 66 are on centers spaced about 5½-inches by about 7⅝-inches, and are slotted to facilitate mounting in a standard automobile rear speaker opening. The frustum 18 of the basket 12 has a major circular diameter at top surface 60 of approximately 5-inches, and a minor diameter of approximately 3-inches at lower portion 48. The tubular duct 56 has an overall length of about 2½-inches and a diameter of about 3-inches. The dimensions of the tubular duct were selected to exert a maximum acoustical impedance on the speaker cone 24 at the frequency of peak electrical impedance, when operating in an enclosure having an air volume equal to the effective volume of the average automobile trunk.

Sizing the tubular duct 56 is an empirical process which is related to both the enclosure parameters and the characteristics of the acoustic driver. (See: David B. Weems, "Taming the Bass Reflex", Radio-Electronics, Feb. 1975, pp 58–61.) Varying the length of the duct 56 permits fine tuning of the lowdspeaker 10 to unusually large or small trunk volumes. If two identical rear speakers are used, the actual trunk volume is halved in computing the effective volume available to each speaker. The above dimensions of the tubular duct 56 were chosen to provide a tuned relationship with a driver 14 baffled by a 5 cu. ft. enclosure, wherein the driver 14 has a 32.5 Hz free air resonance. However, speakers having free air resonant frequencies in the range from about 30 Hz to about 60 Hz may be advantageously applied in the tuned-port arrangement described herein.

Figure 4:
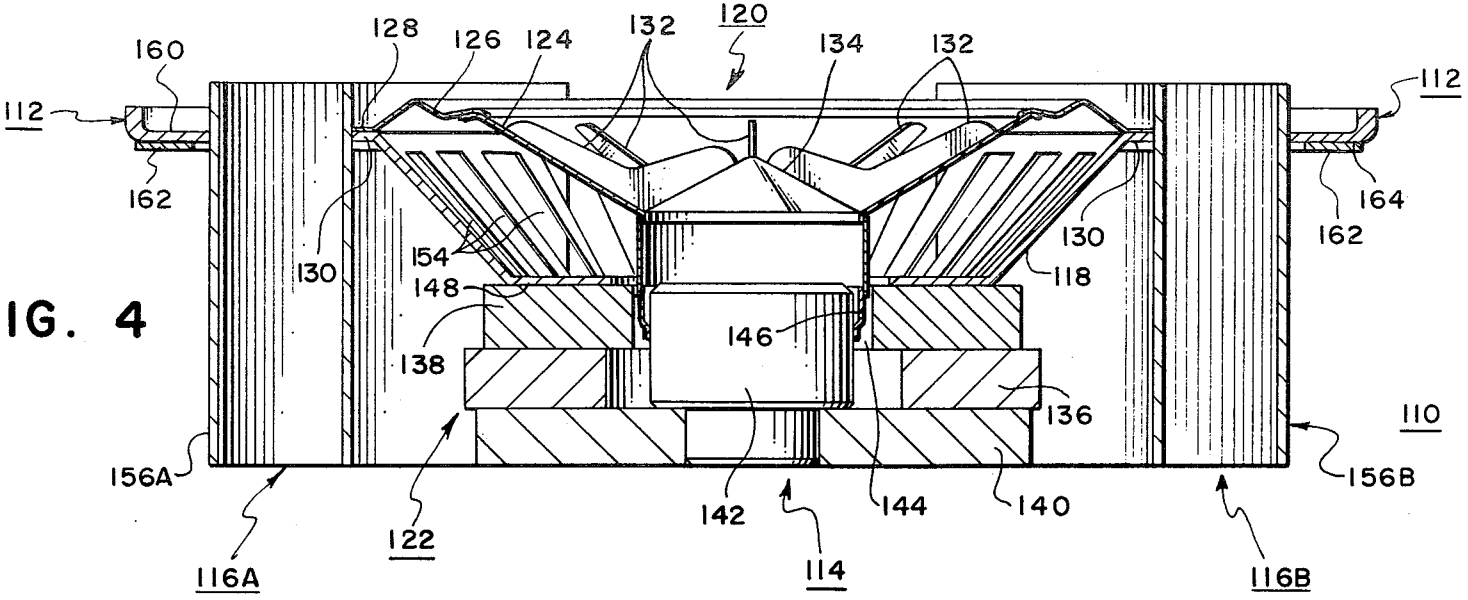
FIG. 4 is a cross section along a line of symmetry of a second embodiment of the invention.
Figure 5:
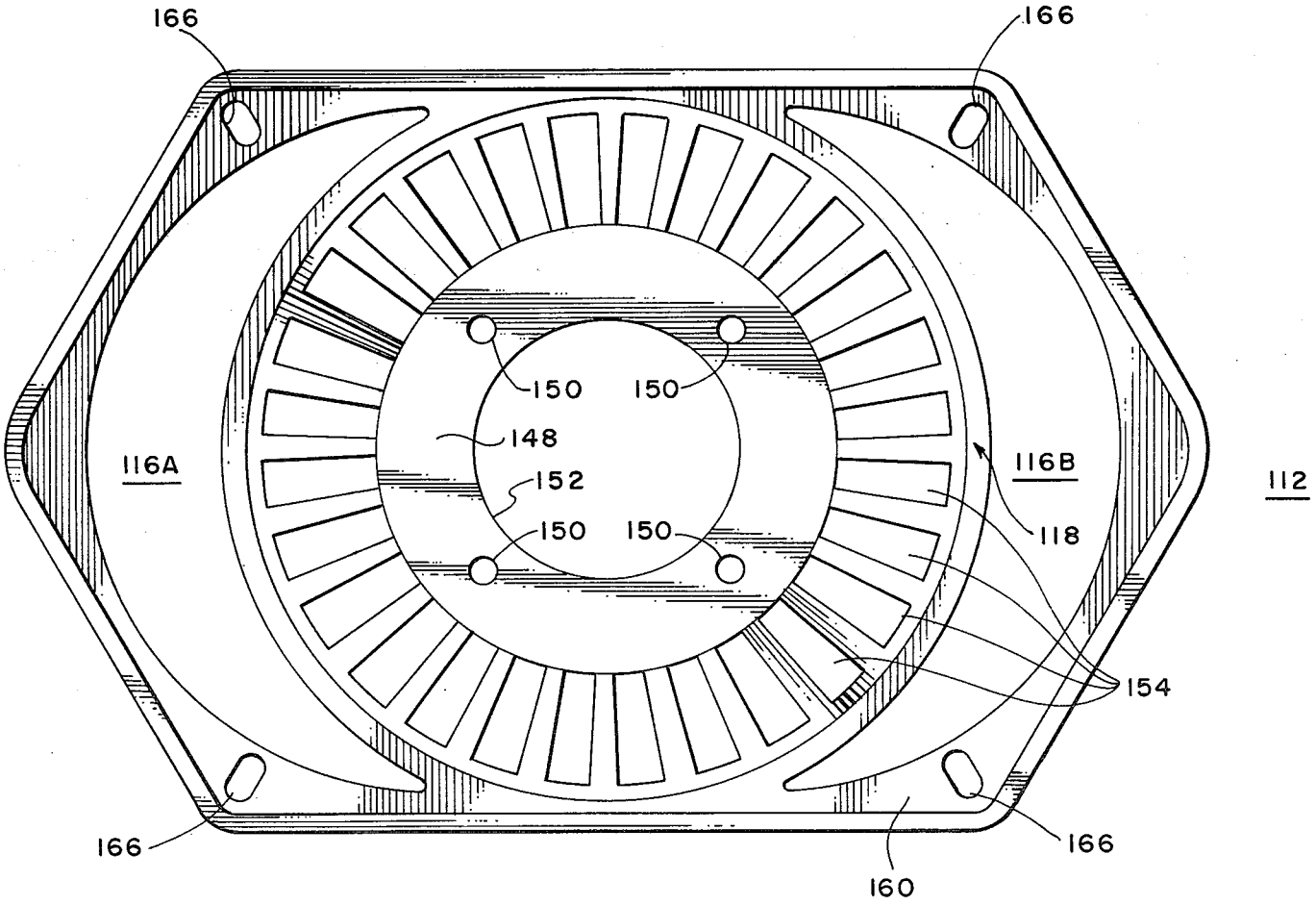
FIG. 5 is a plan view of a speaker basket of the second embodiment.

Now referring to FIG. 4, there is shown an alternate embodiment of the present invention, similar numerals designating similar parts. The principal difference between loudspeaker 110 of FIG. 4 and the loudspeaker 10 of FIG. 1 is the use of a smaller basket 112, which is shown separately in FIG. 5 and measures approximately 5" by 7". The frustum 118 is located approximately in the center of the basket 112, with two generally crescent-shaped tuned ports 116A and 116B juxtaposed on either side of the frustum 118. Referring again to FIG. 4, two ducts 156A and 156B, which are mounted in the basket 112 on opposite sides of the acoustic driver 114, have crescent-shaped cross sections for maximum area utilization in the basket 112, thereby providing a compact loudspeaker 110 of FIG. 4 with acoustic characteristics similar to the loudspeaker 10 of FIG. 1. Other features and characteristics of the alternate embodiment shown in FIG. 4 are similar to those of the principal embodiment shown in FIG. 1.

Figure 6A:
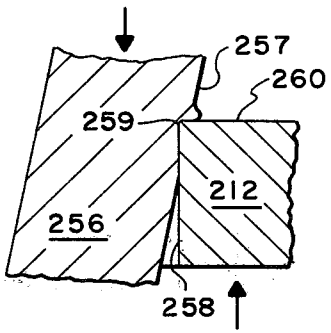
FIG. 6A is an enlarged view of a portion of FIG. 6.
Figure 6:
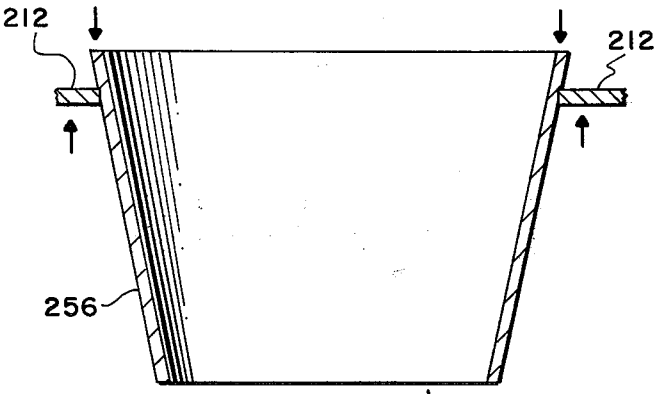
FIG. 6 is a cross section of an alternate embodiment of a tuned port for use in the present invention.

Referring to FIG. 6, there is shown an alternate embodiment of a basket 212 and tuned port 216, wherein only a fragment of the basket 212 is explicitly shown, the details of the entire basket 212 being similar in general respects to the basket 12 of FIGS. 2 and 3. The tuned port 216 comprises a frusto-conical shaped duct 256, which is force-fitted in the basket 212 as shown in more detail in the enlarged view of FIG. 6A.

The duct 256 has an outer surface 257 which is sized to permit most of the duct 256 to pass through aperture 258, whereupon the duct 256 will engage the basket 212 in the manner shown in FIGS. 6 and 6A. A slight force, exerted in the manner indicated by the arrows, will produce a force-fit or interference-fit joint 259, as the outer surface 257 of the duct 256 engages top surface 260 of the basket 212.

After the duct 256 is secured in place in the basket 212, they are preferably permanently joined together in a suitable manner to resist the acoustical vibrations to be experienced in operation. It is further preferred that the duct 256 and basket 212 comprise like materials to avoid thermal fatigue at the joint 259. In the case where members 212 and 256 are made of plastic, a good quality room-temperature-curing epoxy will provide a suitable vibration resistive means for joining the members together. In the case where members 212 and 256 are made of metal, any suitable solder or brazing material will provide a vibration resistive joint. It is presently preferred that the basket 212 and duct 256 comprise aluminum and that they be welded together at the joint 259. It is not necessary, however, that the materials of members 212 and 256 be limited to plastic or metal;

other suitable materials may be substituted as, for example, the duct 256 may be made of a relatively rigid cardboard which may be glued to the basket 212.

Figure 7:
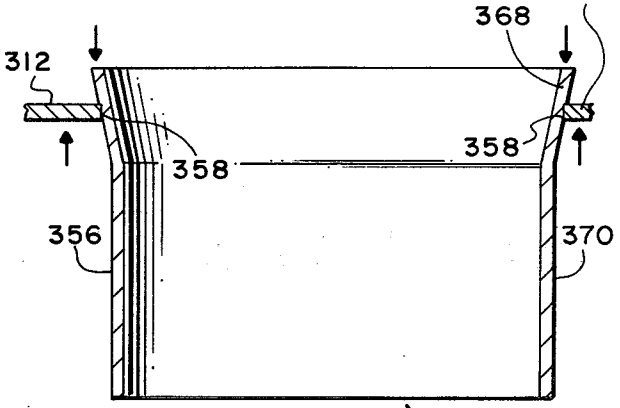
FIG. 7 is a cross section of another alternate embodiment of a tuned port for use in the present invention.

Referring now to FIG. 7, another alternative embodiment of a basket 312 and tuned port 316 is shown. The arrangement of FIG. 7 is similar in all respects to the arrangement shown in FIGS. 6 and 6A except that the tuned port 316 comprises a duct 356 having both a conical portion 368 and a cylindrical portion 370. The lower cylindrical portion 370 is small enough to be inserted into aperture 358 of the basket 312. The upper conical portion is sized to engage the basket 312 in the manner shown, and produce an interference-fit (similarly as illustrated in FIG. 6A) upon the application of a force as indicated by the arrows. The advantage of the embodiment of FIG. 7 over the embodiment of FIG. 6 is that greater air volumes may be obtained in the port 316 if dictated by other parameters such as driver resonance and enclosure size.

Although preferred embodiments of the invention have been described in detail, it is to be understood that various changes, substitutions and alterations can be made therein without departing from the spirit and scope of the invention as defined by the appended claims.

What is claimed is:

1. A speaker assembly for mounting on an acoustic baffle such as the rear deck of an automobile to operate through an opening in the baffle comprising:

a unitary basket member having a frustum and an oval shaped peripheral flange having a planar face adapted to form a peripheral seal about the oval shaped opening in the baffle when held against the face of the baffle by a plurality of fasteners, the frustum including a circular opening for an acoustic driver and the basket face including at least one tuned port means within the confines of the peripheral seal formed by the peripheral flange of the basket, the basket being air tight within the confines of the peripheral seal except for a circular opening for an acoustic driver and tuned port means;

a magnetic structure mounted for support on the frustum and forming a magnetic gap for a coil; and a movable diaphragm assembly, the diaphragm assembly including a coil member, the coil being magnetically coupled in the magnetic gap and the diaphragm member being sealed to the basket around the periphery of the circular opening in the basket whereby the diaphragm seals the circular opening and only the tuned port means provides direct air communication between the opposite sides of the acoustic baffle when the peripheral flange of the basket is held in sealing engagement with the baffle around the periphery of the oval shaped opening.

2. The speaker assembly of claim 1 wherein the peripheral flange of the basket member conforms to a standard automotive six inch by nine inch size with four holes through the peripheral flange for fasteners.

3. The speaker system of claim 1 wherein the tuned port means comprises a single duct disposed at one end.

4. The speaker system of claim 1 wherein the tuned port means comprises two generally crescent-shaped ducts disposed in the basket face on opposite sides of the acoustic driver.

5. The speaker system of claim 1 wherein the basket, including the tuned port means, comprises an integrally cast unit.

6. The speaker system of claim 1 wherein the basket, including the tuned port means, comprises an integrally molded unit.

* * * * *